United States Patent [19]

Ross et al.

[11] 4,447,523

[45] May 8, 1984

[54] PHOTOGRAPHIC ELEMENTS CONTAINING 2,4-DISULFONAMIDOPHENOL SCAVENGERS FOR OXIDIZED DEVELOPING AGENTS

[75] Inventors: Robert E. Ross, Rochester; Wilbur S. Gaugh, Webster, both of N.Y.

[73] Assignee: Eastman Kodak Company, Rochester, N.Y.

[21] Appl. No.: 502,814

[22] Filed: Jun. 9, 1983

Related U.S. Application Data

[63] Continuation-in-part of Ser. No. 389,994, Jun. 18, 1982, abandoned.

[51] Int. Cl.[3] ..... G03C 1/40; G03C 1/06; G03C 7/00

[52] U.S. Cl. ..... 430/505; 430/214; 430/372; 430/551; 430/559; 430/564

[58] Field of Search ..... 430/214, 218, 223, 442, 430/484, 551, 372, 553, 505, 559, 564, 566

[56] References Cited

U.S. PATENT DOCUMENTS

| | | | |
|---|---|---|---|
| 3,737,316 | 6/1973 | Salminen et al. | 96/56.6 |
| 3,770,341 | 11/1973 | Gates, Jr. et al. | 96/29 D |
| 4,175,968 | 11/1979 | Credner et al. | 430/559 |
| 4,205,987 | 6/1980 | Erikson et al. | 430/216 |
| 4,258,117 | 3/1981 | Morgan et al. | 430/214 |
| 4,258,120 | 3/1981 | Gerbal et al. | 430/223 |

OTHER PUBLICATIONS

*Research Disclosure,* Feb. 1979, Item No. 17842.

*Research Disclosure,* Nov. 1976, Item No. 15157, Kestner et al.

*Primary Examiner*—Richard L. Schilling

*Attorney, Agent, or Firm*—Richard E. Knapp

[57] ABSTRACT

Useful scavengers for oxidized developing agents in photographic elements are 2,4-disulfonamidophenols, or alkali labile precursors of such phenols.

15 Claims, No Drawings

PHOTOGRAPHIC ELEMENTS CONTAINING 2,4-DISULFONAMIDOPHENOL SCAVENGERS FOR OXIDIZED DEVELOPING AGENTS

This is a continuation-in-part of Ser. No. 389,994 of Robert E. Ross and Wilbur S. Gaugh, filed June 18, 1982 and now abandoned entitled "Photographic Elements Containing Scavengers For Oxidized Developing Agents."

This invention relates to photographic elements, and in particular to color photographic elements containing novel scavengers for oxidized developing agent.

It is known in the art to add scavengers for oxidized developing agent to photographic elements in order for the scavenger to interact with the oxidized developing agent and prevent it from reacting at an undesired location or at an undesired point in time. Included among the scavengers for oxidized developing agent known in the art are the ballasted 2,5-disulfonamidophenols shown in Erikson et al, U.S. Pat. No. 4,205,987 issued June 3, 1980 and the 2-, or 4-sulfonamidophenols shown in *Research Disclosure,* February, 1979, Item No. 17842. *Research Disclosure* is published by Industrial Opportunities Ltd., Homewell, Havant, Hampshire, PO9 1EF, United Kingdom.

It is known in the art that certain phenols are dye-forming couplers and that they will react with oxidized color developing agents to form cyan dye. 4-Sulfonamidophenols are specifically disclosed in Salminen et al, U.S. Pat. No. 3,737,316 issued June 5, 1973 as being dye-forming couplers.

In view of the knowledge which those skilled in the art possess regarding the ability of phenols to couple with oxidized color developing agents, it would be expected that the scavengers described in Erikson et al, and *Research Disclosure,* referred to above, would couple with oxidized color developing agents to form dye stain and therefore would be of limited utility in photographic elements intended to be processed with oxidized color developing agents where such stain would be objectionable. Thus, the sulfonamidophenols of Erikson et al and *Research Disclosure* have found their principal utility in those image transfer materials which do not employ color developing agents for processing or in those materials where the scavenger is in a layer where it is not visible upon viewing of the final image.

We have confirmed that 2,5-disulfonamidophenols of Erikson et al and 4-sulfonamidophenols of *Research Disclosure* do in fact, couple with oxidized color developing agents. However, we have unexpectedly found that 2,4-disulfonamidophenols do not couple under normal conditions for processing color photographic negatives, as in Example 3 below. Thus, such compounds would be useful not only in image transfer applications but also in materials intended to be processed with color developing agents.

In accordance with the present invention, there is provided a photographic element comprising a support and at least one silver halide emulsion layer, the element containing as a scavenger for oxidized developing agent, a 2,4-disulfonamidophenol or an alkali labile precursor of such a phenol.

Preferred sulfonamidophenol scavengers for oxidized developing agents of the present invention can be represented by the structural formula:

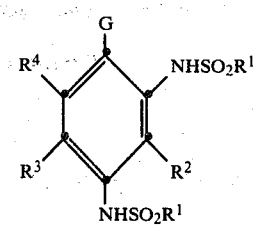

wherein:

G is hydroxy or an alkali labile precursor thereof.

Each $R^1$ is individually alkyl of 1 to 30 carbon atoms, aryl of 6 to 30 carbon atoms or heterocyclyl of 5 to 30 atoms containing one or more ring heteroatoms selected from nitrogen, oxygen, sulfur and selenium; and $R^2$, $R^3$ and $R^4$ are each individually hydrogen, halogen, alkyl of 1 to 30 carbon atoms, alkoxy of 1 to 30 carbon atoms, aryl of 6 to 30 carbon atoms or aryloxy of 6 to 30 carbon atoms, the scavenger being of sufficient bulk so as to be non-diffusible in the alkali permeable layers of the element.

Especially preferred sulfonamidophenol scavengers have the structural formula:

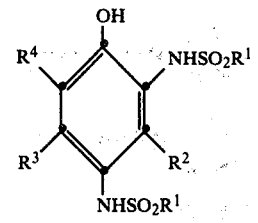

wherein:

Each $R^1$ is individually alkyl of 1 to 30 carbon atoms, or aryl of 6 to 30 carbon atoms; and $R^2$, $R^3$ and $R^4$ are each individually hydrogen, alkyl of 1 to 30 carbon atoms or alkoxy of 1 to 30 carbon atoms.

In particularly preferred scavengers $R^3$ is alkyl of 1 to 4 carbon atoms or alkoxy of 1 to 4 carbon atoms and $R^2$ and $R^4$ are hydrogen.

As indicated above, the moiety G can be a hydroxy group or an alkali labile precursor of a hydroxy group. In the alkali labile precursors, the hydrogen atom of the hydroxy group is replaced with a blocking group which is removed upon contact with base. Typical blocking groups are removable by hydrolysis or by intramolecular nucleophilic displacement. Typical groups removable by hydrolysis are acyl groups such as aliphatic and aromatic carbonyl and sulfonyl groups. Typical groups removable by intramolecular nucleophilic displacement are described in Mooberry et al, U.S. Pat. No. 4,310,612 issued Jan. 12, 1982.

The alkyl, alkoxy, aryl, and aryloxy substituents described above can be further substituted. Representative such substituents include halogen, nitro, alkyl, aryl, alkenyl, alkoxy, aryloxy, alkenyloxy, heterocyclyl, alkylcarbonyl, arylcarbonyl, alkenylcarbonyl, alkylsulfonyl, arylsulfonyl, alkenylsulfonyl, amino, aminocarbonyl, aminosulfonyl, carboxy, alkoxycarbonyl, aryloxycarbonyl, alkenyloxycarbonyl, sulfo groups and the like. Thus, alkyl is inclusive of, e.g., arylalkyl and aryloxyalkyl, aryl is inclusive of, e.g., alkaryl and alkoxyaryl, and alkenyl is inclusive of, e.g., aralkenyl. The amine portions of these further substituents include primary, secondary, and tertiary amines as well as acylated amines.
Representative scavengers of the present invention are shown below.
1.
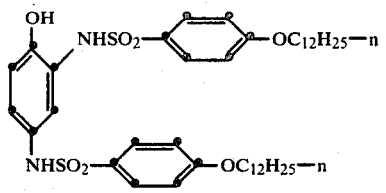
2.
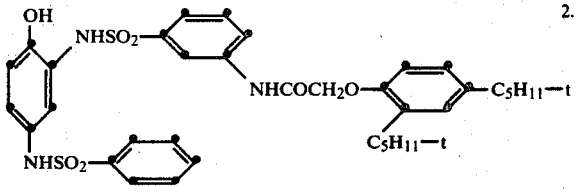
3.
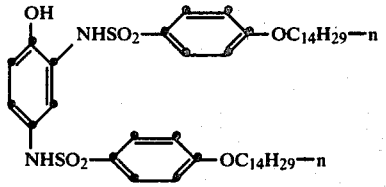
4.
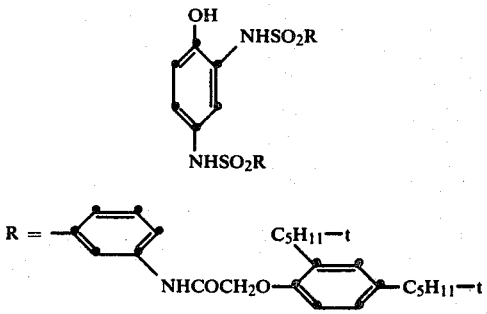
5.
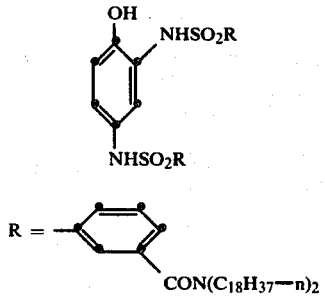
6.
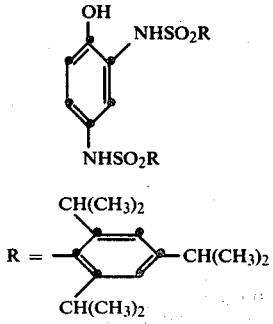
-continued
7.
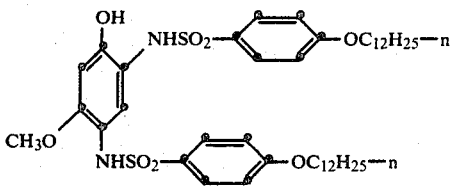
8.
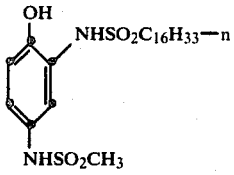
9.
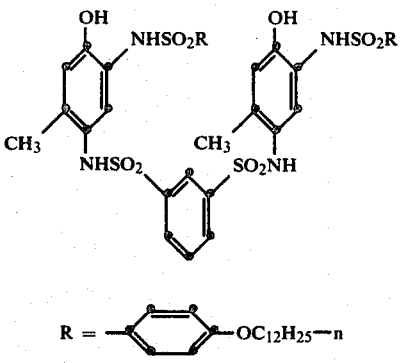
10.
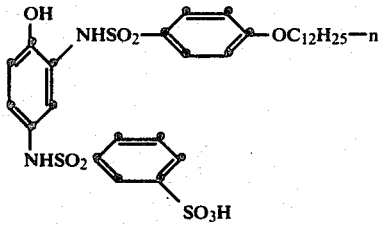
11.
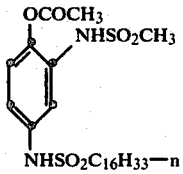
12.
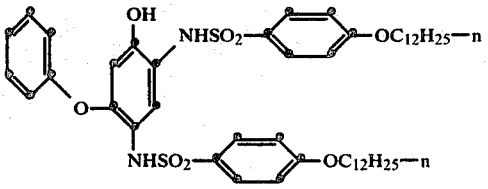
13.
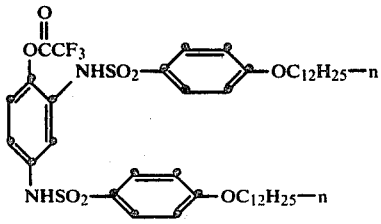

-continued

14.

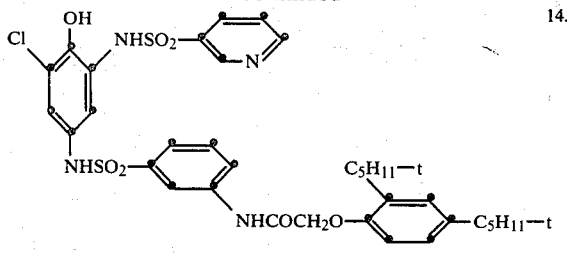

15.

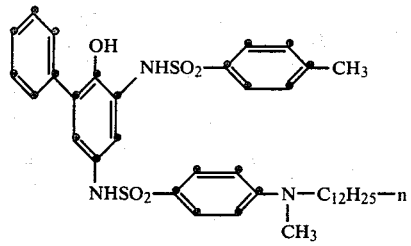

16.

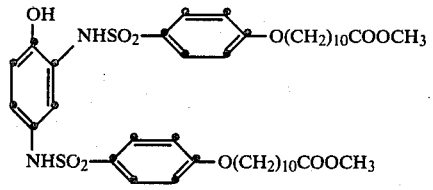

The compounds of the present invention are known compounds or similar to known compounds and can be prepared by known reactions. To prepare compounds in which the sulfonamido groups in the 2- and 4-position are identical, a 2,4-diaminophenol is reacted with the appropriate sulfonyl halide. If dissimilar sulfonamido groups are desired, a 2-amino-4-nitrophenol or a 4-amino-2-nitrophenol is reacted with an appropriate sulfonyl halide to attach one of the groups to the amino substituent, the nitro group is then reduced and a second sulfonyl halide is attached to the amino group formed by reduction of the nitro group. If blocked compounds are to be prepared, the blocking group can be attached to the hydroxy either before or after attachment of the sulfonamido groups. Representative preparations are shown in the working examples.

The scavengers of this invention can be used in the ways and for the purposes that scavengers for oxidized developing agent are employed in the art. They can be incorporated in a silver halide emulsion layer of the photographic element or in a separate layer of the element. When incorporated in a separate layer, that layer is preferably an interlayer between silver halide emulsion layers although it can be an undercoat layer coated below all of the silver halide emulsion layers or an overcoat layer coated above all of the silver halide emulsion layers. The scavengers can be prepared to contain water solubilizing groups which aid the scavengers in being compatible with the emulsion layer. The scavengers can also optionally be prepared to have limited mobility in the various layers of the photographic element so that the scavenger can move into the emulsion layer at the desired time. This limited mobility can optionally enable the scavenger to compete during processing with the coupler for oxidized developer.

The amount of scavenger compound employed will depend upon the particular purpose for which the scavenger is to be used and the degree of scavenging desired. Typically useful results are obtained when the scavenger is employed in an amount of between about 5 and 2000 mg/sq. meter.

The scavenger can be incorporated in photographic elements by techniques known in the art. In certain preferred embodiments, the scavenger is dissolved in a high boiling solvent, such as a water insoluble coupler solvent and then dispersed either in a silver halide emulsion layer or in a separate vehicle such as gelatin. Typical useful coupler solvents are moderately polar solvents such as tritolylphosphate, di-n-butylphthalate, diethyllauramide, 2,4-dipentylphenol, and the like. Typical vehicles are gelatin, and other hydrophilic colloids commonly employed in silver halide photographic elements. These vehicles are described in *Research Disclosure,* December 1978, Item No. 17643, Section IX. The scavengers can be introduced into the element in a polymeric latex. Suitable techniques for dispersing the scavengers in a latex are described in U.S. Pat. Nos. 4,203,716 and 4,214,047 and in *Research Disclosure,* July 1977, Item 15930 and July 1980, Item 19551.

The photographic elements of the present invention can be simple black-and-white or monochrome elements comprising a support bearing a layer of the silver halide emulsion, or they can be multilayer and/or multicolor elements. They can be designed for processing with separate solutions or for in-camera processing. Multicolor elements contain dye image forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsion or emulsions can be disposed as one or more segmented layers, e.g., as by the use of microvessels or microcells, as described in Whitmore U.S. Pat. No. 4,362,806 issued Dec. 7, 1982.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material, the element containing a scavenger of this invention. Preferably the scavenger is in an interlayer between silver halide emulsion layers sensitive to different regions of the visible spectrum although it can be in a silver halide emulsion layer or in an interlayer between silver halide emulsion layers sensitive to the same region of the visible spectrum.

The elements of the present invention can contain additional layers conventional in photographic elements, such as overcoat layers, spacer layers, filter layers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in *Research Disclosure,* December 1978, Item 17643, referred to above.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide, and mixtures thereof. The emulsions can be, for example, tabular grain light-sensitive silver halide emulsions. The emulsions can be negative working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in *Research Disclosure,* Item 17643, December, 1978 and the references listed therein.

The photographic silver halide emulsions can contain other addenda conventional in the photographic art. Useful addenda are described, for example, in *Research Disclosure,* December 1978, Item 17643. Useful addenda include spectral sensitizing dyes and desensitizers, antifoggants, masking couplers, DIR couplers, DIR compounds, anti-stain agents, image dye stabilizers, absorbing materials such as filter dyes and UV absorbers, light scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and napthols. Preferred couplers which form magenta dye images are pyrazolones and pyrazolotriazoles. Preferred couplers which form yellow dye images are benzoylacetanilides and pivalylacetanilides.

Dye-image-providing materials useful in diffusion transfer film units contain a dye moiety and a monitoring moiety. The monitoring moiety, in the presence of an alkaline processing solution and as a function of silver halide development, is responsible for a change in mobility of the dye moiety. These dye-image-providing materials can be initially mobile and rendered immobile as a function of silver halide development, as described in U.S. Pat. No. 2,983,606. Alternatively, they can be initially immobile and rendered mobile, in the presence of an alkaline processing solution, as a function of silver halide development. This latter class of materials include redox dye-releasing compounds. In such compounds, the monitoring group is a carrier from which the dye is released as a direct function of silver halide development or as an inverse function of silver halide development. Compounds which release dye as a direct function of silver halide development are referred to as negative-working release compounds, while compounds which release dye as an inverse function of silver halide development are referred to as positive-working release compounds.

A preferred class of negative-working release compounds are the ortho or para sulfonamidophenols and naphthols described in U.S. Pat. Nos. 4,054,312, 4,055,428 and 4,076,529. In these compounds the dye moiety is attached to a sulfonamido group which is ortho or para to the phenolic hydroxy group and is released by hydrolysis after oxidation of the sulfonamido compound during development.

A preferred class of positive-working release compounds are the nitrobenzene and quinone compounds described in U.S. Pat. No. 4,139,379. In these compounds the dye moiety is attached to an electrophilic cleavage group, such as a carbamate group, ortho to the nitro group or the quinone oxygen, and is released upon reduction of the compound by an electron donor compound contained in the element or the processing composition, unless the electron donor is oxidized during development.

The developing agents which can be used to develop the photographic elements of this invention, the oxidized form of which can be reduced by the scavengers of this invention, include hydroquinones, aminophenols, 3-pyrazolidones and phenylenediamines. Some of these developing agents, when used for certain applications, are referred to in the art as electron transfer agents. The particular developing agent employed will depend on the particular type of photographic element to be processed. For example, phenylenediamines are the developers of choice for use with color photographic elements containing dye-forming couplers, while 3-pyrazolidones are preferably used with image transfer materials containing redox dye releasers.

Representative developing agents include: hydroquinone, N-methylaminophenol, 1-phenyl-3-pyrazolidone, 1-phenyl-4,4-dimethyl-3-pyrazolidone, 1-phenyl-4-methyl-4-hydroxymethyl-3-pyrazolidone, N,N-diethyl-p-phenylenediamine, 3-methyl-N,N-diethyl-p-phenylenediamine, 3-methoxy-N,N-diethyl-p-phenylenediamine, N,N,N′,N′-tetramethyl-p-phenylenediamine.

The term "non-diffusible" used herein has the meaning commonly applied to the term in photography and denotes materials that for all practical purposes do not migrate or wander through organic colloid layers of a photographic element, such as gelatin, when the element is processed in an alkaline medium, preferably when processed in a medium having a pH of 10 or greater. The term "diffusible" has the converse meaning and denotes the materials having the property of diffusing effectively through the colloid layers of photographic elements in an alkaline medium.

The term "associated therewith" as used herein is intended to mean that the materials can be in either the same or different layers so long as the materials are accessible to one another during processing.

The following examples further illustrate this invention.

EXAMPLE 1

Preparation of Compound 1

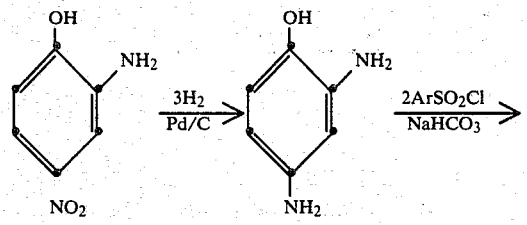

(1a) (1b)

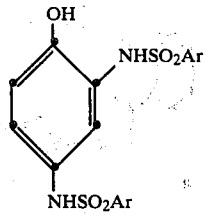

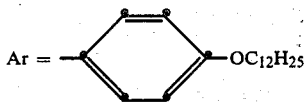

A mixture of 4.5 g (0.03 mole) 2-amino-4-nitrophenol and palladium on charcoal catalyst in 60 ml dimethylformamide was reduced in a Parr bottle with 40 psi hydrogen until the theoretical amount was taken up. Immediately after removal of the catalyst by filtration, 6.3 g (0.075 mole) sodium bicarbonate and 21.7 g (0.06 mole) 4-dodecyloxybenzenesulfonyl chloride were added with stirring and the mixture was heated to drive off carbon dioxide. The product isolated by pouring the reaction mixture into ice water was recrystallized in turn from methanol, ethanol/hexane, and acetonitrile to yield 7.5 g nearly colorless crystals, m.p. 137°-139° C. with the correct elemental analysis for Compound 1.

EXAMPLE 2

Preparation of Compound 8

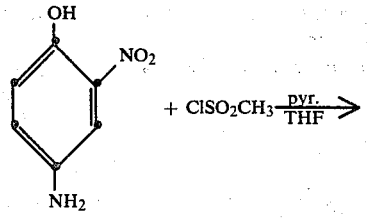

(2a)

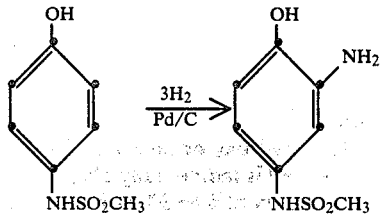

(2b) (2c)

-continued

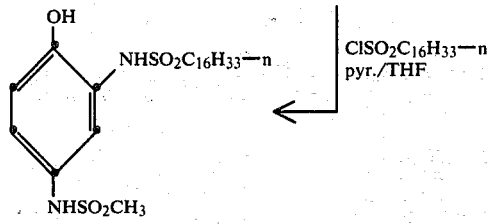

To a −10° C. solution of 46.2 g (0.3 mole) 4-amino-2-nitrophenol in 500 ml tetrahydrofuran and 240 ml pyridine was added dropwise over 10 minutes with stirring 34.4 g (0.3 mole) methanesulfonyl chloride. After stirring overnight the liquid reaction mixture was poured into a vigorously stirred solution of 240 ml concentrated hydrochloric acid in 800 ml water and the resulting precipitate was collected, washed, dried, decolorized, and recrystallized from acetonitrile to yield 32.5 g yellow crystals of (2b), m.p. 164°-6° C., with the correct infrared and NMR spectra and a good elemental analysis.

A solution of 15 g (0.065 mole) (2b) in 80 ml tetrahydrofuran and 80 ml methanol was hydrogenated overnight over palladium on charcoal in a Parr apparatus. Then the catalyst was removed by filtration and the solvent by evaporation. The resultant gray solid (2c) was dissolved in 200 ml tetrahydrofuran and 50 ml pyridine and a solution of 21 g (0.065 mole) 1-hexadecanesulfonyl chloride in 100 ml tetrahydrofuran was added dropwise with stirring. After 4 hours the reaction mixture was poured onto 600 ml ice water containing 50 ml concentrated hydrochloric acid and the precipitate collected. Recrystallization from acetonitrile afforded 15.7 g white crystals, m.p. 147°-9° C., with the correct analysis and spectra for Compound 8.

EXAMPLE 3

Photographic Evaluation

To evaluate the compounds of this invention with respect to their effectiveness as interlayer scavengers for oxidized color developing agents a color negative test format was employed represented by the following schematic structure:

| | | |
|---|---|---|
| Overcoat: | Gelatin 0.86 g/m$^2$, Hardener 1.75% | |
| Causing Layer: | Silver Halide | 1.61 g/m$^2$ |
| | Yellow Coupler | 0.34 g/m$^2$ |
| | Gelatin | 2.42 g/m$^2$ |
| Interlayer: | Test Compound 0.123 mmol/m$^2$ | |
| Receiving Layer: | Cyan Coupler | 1.12 g/m$^2$ |
| | Gelatin | 2.42 g/m$^2$ |
| ////////////////////// Film Support ////////////////////// | | |

In this element the hardener is bis(vinylsulfonylmethyl)ether and the couplers have the following structures:

Yellow Coupler:

-continued

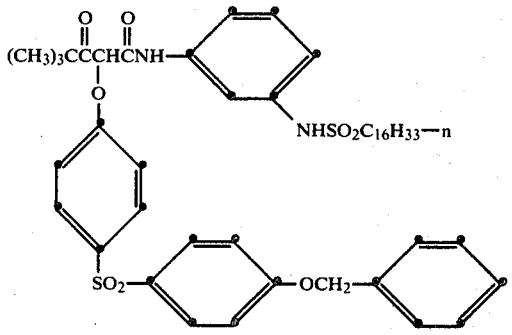

Cyan Coupler:

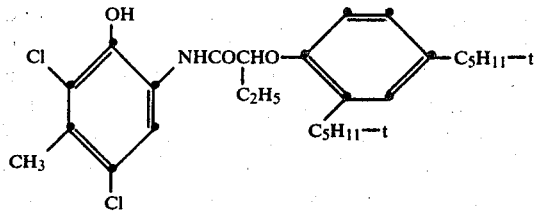

Couplers and test compounds were coated as dispersions in dibutylphthalate or a comparable coupler solvent. In this system, oxidized color developer, originating in the causing layer as the exposed silver halide develops, can react with the yellow coupler to form a yellow dye. It can also migrate through the interlayer to the receiving layer to react with coupler there to form a cyan dye. Reactive test compounds in the interlayer can also react with oxidized developer, thus limiting cyan dye formation in the receiving layer. For color negative materials it is usually more desirable that the test compound reduce oxidized developer rather than coupling with it, since the latter reaction can result in unwanted dye stain.

Scavenging efficiency of each test compound can be determined by measuring the developed density ratio of cyan dye (at 665 nm) to yellow dye (at 450 nm). The more active test compounds reduce this red/blue density ratio to about 0.2 from a control value (no scavenger in the interlayer) of about 0.4. The most useful scavengers will continue to give a low density ratio after an accelerated keeping test of the unexposed element while others will lose their effectiveness by being oxidized and a higher red/blue density ratio will result.

The rate of scavenger oxidation observed during normal film keeping conditions can be accelerated, for example, by increasing the temperature, humidity, or partial pressure of oxygen in the test system. One such accelerated keeping test is described in Example 3 of U.S. Pat. No. 4,205,987.

One sample of each of the photosensitive elements, prepared as described above to contain a different desired test compound, was exposed through a graduated density test object and then processed as described in the *British Journal of Photography* July 12, 1974, pp. 597–8. A second sample of each element was incubated in an accelerated keeping test and then exposed and processed in the same way as the fresh samples. The cyan dye contamination (red density) of the final yellow dye image (blue density) was then measured for the samples, both fresh and incubated. Coupling of the scavenger was determined by visual inspection of a cross-section of the sample. If cyan dye density was observed in the interlayer, the scavenger was considered to have coupled with oxidized developing agent. The results are presented in the following table.

TABLE I

| Scavenger Compound | Red/Blue Density Ratio Fresh | Red/Blue Density Ratio Incubated | Observed Dox Coupling |
|---|---|---|---|
| None (Control) | 0.40 | 0.42 | No |
| A (Comparison) | 0.36 | Not Measured | Yes |
| B (Comparison) | 0.40 | Not Measured | Yes |
| 1 | 0.18 | 0.20 | No |
| 3 | 0.18 | 0.20 | No |
| 4 | 0.19 | 0.20 | No |
| 7 | 0.32 | 0.34 | No |

Comparison compounds used as controls:

(A)

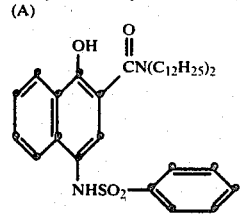

(B)

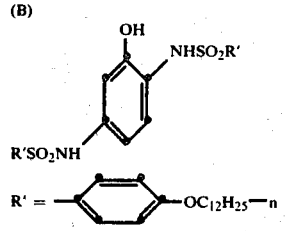

It can be seen from the above table that the control compounds at equimolar levels show less scavenging ability and greater propensity for undesired coupling to form dye than do the compounds of the invention.

The invention has been described in detail with particular reference to preferred embodiments thereof, but it will be understood that variations and modifications can be effected within the spirit and scope of the invention.

What is claimed is:

1. In a photographic element comprising a support and at least one silver halide emulsion layer, the element containing a scavenger for oxidized developing agent which does not form a dye or release a photographically useful group upon reaction with said oxidized developing agent, the improvement wherein the scavenger is a 2,4-disulfonamidophenol or an alkali labile precursor of such a phenol.

2. A photographic element of claim 1, wherein the scavenger has the structural formula:

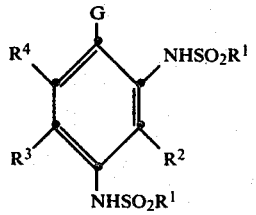

wherein:

G is hydroxy or an alkali labile precursor thereof;

each $R^1$ is individually alkyl of 1 to 30 carbon atoms, or aryl of 6 to 30 carbon atoms or heterocyclyl of 5 to 30 atoms containing one or more ring hetero atoms selected from nitrogen, oxygen, sulfur and selenium; and $R^2$, $R^3$ and $R^4$ are each individually hydrogen, halogen, alkyl of 1 to 30 carbon atoms, alkoxy of 1 to 30 carbon atoms, aryl of 6 to 30 carbon atoms or aryloxy of 6 to 30 carbon atoms, the scavenger being of sufficient bulk so as to be non-diffusible in the alkali permeable layers of the element.

3. A photographic element of claim 2 wherein the scavenger has the structural formula:

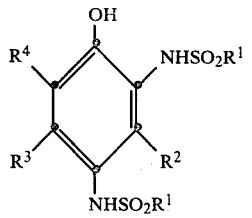

wherein:

each $R^1$ is individually alkyl of 1 to 30 carbon atoms, or aryl of 6 to 30 carbon atoms; and $R^2$, $R^3$ and $R^4$ are each individually hydrogen, alkyl or 1 to 30 carbon atoms or alkoxy of 1 to 30 carbon atoms.

4. A photographic element of claim 3 wherein $R^3$ is alkyl of 1 to 4 carbon atoms or alkoxy of 1 to 4 carbon atoms and $R^2$ and $R^4$ are hydrogen.

5. A photographic element of any one of claims 1, 2 or 3, wherein the scavenger is in an interlayer between two silver halide emulsion layers.

6. A photographic element of any one of claims 1, 2 or 3, wherein the scavenger is in a silver halide emulsion layer.

7. A photographic element of claim 1, wherein the silver halide emulsion layer has associated therewith an image dye providing material.

8. A photographic element of claim 7, wherein the image dye providing material is a dye-forming coupler.

9. A photographic element of claim 7, wherein the image dye providing material is a redox dye releaser.

10. In a photographic element comprising a support, at least two silver halide emulsion layers containing dye-forming couplers and a scavenger for oxidized developing agent which does not form a dye or release a photographically useful group upon reaction with said oxidized developing agent, the improvement wherein the scavenger is a 2,4-disulfonamidophenol or an alkali labile precursor of such a phenol.

11. A photographic element of claim 10 wherein the scavenger is in an interlayer between two silver halide emulsion layers.

12. A photographic element of claim 10 wherein the scavenger is in a silver halide emulsion layer.

13. A photographic element of any one of claims 10, 11 or 12 wherein the scavenger has the structural formula:

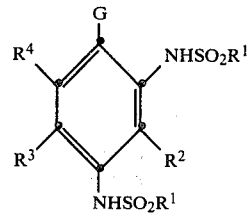

wherein:

G is hydroxy or an alkali labile precursor thereof;

each $R^1$ is individually alkyl of 1 to 30 carbon atoms, or aryl of 6 to 30 carbon atoms or heterocyclyl of 5 to 30 atoms containing one or more ring hetero atoms selected from nitrogen, oxygen, sulfur and selenium; and $R^2$, $R^3$ and $R^4$ are each individually hydrogen, halogen, alkyl of 1 to 30 carbon atoms, alkoxy of 1 to 30 carbon atoms, aryl of 6 to 30 carbon atoms or aryloxy of 6 to 30 carbon atoms, the scavenger being of sufficient bulk so as to be non-diffusible in the alkali permeable layers of the element.

14. A photographic element of any one of claims 10, 11 or 12 wherein the scavenger has the structural formula:

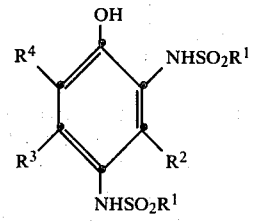

wherein:

each $R^1$ is individually alkyl of 1 to 30 carbon atoms, or aryl of 6 to 30 carbon atoms; and $R^2$, $R^3$ and $R^4$ are each individually hydrogen, alkyl or 1 to 30 carbon atoms or alkoxy of 1 to 30 carbon atoms.

15. A photographic element of claim 14 wherein $R^3$ is alkyl of 1 to 4 carbon atoms or alkoxy of 1 to 4 carbon atoms and $R^2$ and $R^4$ are hydrogen.

* * * * *